US011339479B2

(12) United States Patent
Koll et al.

(10) Patent No.: US 11,339,479 B2
(45) Date of Patent: May 24, 2022

(54) COMPONENT MADE OF PRESS-FORM-HARDENED, ALUMINUM-BASED COATED STEEL SHEET, AND METHOD FOR PRODUCING SUCH A COMPONENT

(71) Applicants: SALZGITTER FLACHSTAHL GMBH, Salzgitter (DE); VOLKSWAGEN AKTIENGESELLSCHAFT, Wolfsburg (DE)

(72) Inventors: Thomas Koll, Braunschweig (DE); Marc Debeaux, Hildesheim (DE); Friedrich Luther, Gehrden (DE); Christian Fritzsche, Salzgitter (DE); Stefan Mütze, Peine (DE); Frank Beier, Staufenberg (DE); Matthias Graul, Brome (DE); Jan-Frederik Lass, Wolfsburg (DE); Haucke-Frederik Hartmann, Herzberg (DE)

(73) Assignees: SALZGITTER FLACHSTAHL GMBH, Salzgitter (DE); VOLKSWAGEN AKTIENGESELLSCHAFT, Wolfsburg (DE)

( * ) Notice: Subject to any disclaimer, the term of this patent is extended or adjusted under 35 U.S.C. 154(b) by 680 days.

(21) Appl. No.: 16/093,466

(22) PCT Filed: Apr. 13, 2017

(86) PCT No.: PCT/EP2017/058918

§ 371 (c)(1),
(2) Date: Oct. 12, 2018

(87) PCT Pub. No.: WO2017/182382

PCT Pub. Date: Oct. 26, 2017

(65) Prior Publication Data

US 2020/0308708 A1 Oct. 1, 2020

(30) Foreign Application Priority Data

Apr. 18, 2016 (DE) ..... 102016107152.8

(51) Int. Cl.
*B32B 15/10* (2006.01)
*C23C 28/00* (2006.01)
(Continued)

(52) U.S. Cl.
CPC ..... *C23C 28/321* (2013.01); *C23C 2/12* (2013.01); *C23C 2/28* (2013.01); *C23C 2/40* (2013.01);
(Continued)

(58) Field of Classification Search
None
See application file for complete search history.

(56) References Cited

U.S. PATENT DOCUMENTS 4,546,051 A * 10/1985 Uchida ..... C23C 2/12 148/505
6,017,643 A * 1/2000 Kobayashi ..... C23C 2/12 118/407
(Continued)

FOREIGN PATENT DOCUMENTS

CA 2933039 A1 7/2015
DE 2836878 C2 11/1979
(Continued)

OTHER PUBLICATIONS

Russian Search Report dated Jun. 18, 2019 by the Russian Patent Office in Russian Application No. 2018136149/02(059722).
(Continued)

*Primary Examiner* — Seth Dumbris
(74) *Attorney, Agent, or Firm* — Henry M. Feiereisen LLC

(57) ABSTRACT

In a component made of press-form-hardened, aluminium-based coated steel sheet, the coating has a covering which
(Continued)

contains aluminum and silicon applied in the hot-dip process. The press-form-hardened component in the transition region between steel sheet and covering has an inter-diffusion zone I, wherein, depending on the layer application of the covering before heating and press hardening, the thickness of the inter-diffusion zone I obeys the following formula: I [μm]<(1/35)×application on both sides [g/m$^2$]+(19/7). Formed on the inter-diffusion zone I is a zone having various intermetallic phases having an average total thickness between 8 and 50 μm, on which zone there is in turn arranged a covering layer containing aluminum oxide and/or hydroxide having an average thickness of at least 0.05 μm to at most 5 μm.

9 Claims, 2 Drawing Sheets

(51) Int. Cl.

| | |
|---|---|
| ***C23C 2/12*** | (2006.01) |
| ***C23C 2/28*** | (2006.01) |
| ***C23C 2/40*** | (2006.01) |
| ***C23C 8/10*** | (2006.01) |
| ***C23C 8/80*** | (2006.01) |

(52) U.S. Cl.
CPC ..... *C23C 8/10* (2013.01); *C23C 8/80* (2013.01); *C23C 28/345* (2013.01); *Y10T 428/12757* (2015.01)

(56) References Cited

U.S. PATENT DOCUMENTS

| | | | | |
|---|---|---|---|---|
| 8,404,061 | B2 | 3/2013 | Luther et al. | |
| 10,036,085 | B2 | 7/2018 | Luther et al. | |
| 2011/0006491 | A1* | 1/2011 | Spehner | B21D 22/022 280/1 |
| 2011/0165436 | A1* | 7/2011 | Drillet | C23C 2/26 428/653 |
| 2011/0300407 | A1* | 12/2011 | Cho | C23C 2/34 428/653 |
| 2012/0107632 | A1 | 5/2012 | Luther et al. | |
| 2012/0305139 | A1 | 12/2012 | Luther et al. | |
| 2013/0037178 | A1* | 2/2013 | Coryell | C21D 1/673 148/525 |
| 2014/0048181 | A1* | 2/2014 | Banik | C21D 1/673 148/230 |
| 2015/0020992 | A1 | 1/2015 | Luther et al. | |
| 2015/0041024 | A1 | 2/2015 | Luther et al. | |
| 2015/0047753 | A1 | 2/2015 | Luther et al. | |
| 2016/0130675 | A1 | 5/2016 | Mütze et al. | |
| 2016/0215376 | A1 | 7/2016 | Luther et al. | |
| 2016/0281252 | A1 | 9/2016 | Luther et al. | |
| 2017/0333971 | A1 | 11/2017 | Mütze et al. | |

FOREIGN PATENT DOCUMENTS

| | | | |
|---|---|---|---|
| DE | 19853285 | C1 | 6/2000 |
| DE | 69933751 | T2 | 10/2007 |
| EP | 2017074 | A2 | 1/2009 |
| EP | 2312011 | A1 | 4/2011 |
| EP | 2449137 | | 5/2012 |
| EP | 2993248 | A1 | 3/2016 |
| RU | 2563421 | | 9/2015 |
| WO | WO 2015/150892 | | 10/2015 |
| WO | WO 2015/098653 | A1 | 3/2017 |

OTHER PUBLICATIONS

English translation of Russian Search Report dated Jun. 18, 2019 by the Russian Patent Office in Russian Application No. 2018136149/02(059722).
International Search Report issued by the European Patent Office in International Application PCT/EP2017/058918.
"Surface & Coatings Technology" by M. Windmann, A. Röttger, W. Theisen, Apr. 6, 2013.
"Surface & Coatings Technology" by Yo-Yu Chang, Charng-Cheng Tsaur, James C. Rock, Jan. 4, 2006.
"Metallurgy of continuous hot dip aluminizing" by R. W. Richards, R. D. Jones, P. D. Clements & H. Clarke, Jul. 18, 2013.

* cited by examiner

COMPONENT MADE OF PRESS-FORM-HARDENED, ALUMINUM-BASED COATED STEEL SHEET, AND METHOD FOR PRODUCING SUCH A COMPONENT

CROSS-REFERENCES TO RELATED APPLICATIONS

This application is the U.S. National Stage of International Application No. PCT/EP2017/058918, filed Apr. 13, 2017, which designated the United States and has been published as International Publication No. WO 2017/182382 and which claims the priority of German Patent Application, Serial No. 10 2016 107 152.8, filed Apr. 18, 2016, pursuant to 35 U.S.C. 119(a)-(d).

BACKGROUND OF THE INVENTION

The invention relates to a component of press-form-hardened steel sheet with an aluminium-based coating, wherein the coating comprises a coat applied in the hot-dipping process and containing aluminium and silicon. The invention also relates to a method for producing such a component. In particular, the coating relates to an aluminium-silicon coat.

It is known that hot-formed steel sheets are being used with increasing frequency in particular in automotive engineering. By means of the process which is defined as press-hardening, it is possible to produce high-strength components which are used predominantly in the region of the bodywork. Press-hardening can fundamentally be carried out by means of two different method variations, namely by means of the direct or indirect method. Whereas the process steps of forming and hardening are performed separately from one another in the indirect method, they take place together in one tool in the direct method. Only the direct method will be considered hereinafter.

In the direct method, a steel sheet is heated above the so-called austenitization temperature (Ac3). Then, the thus heated steel sheet is transferred to a forming tool and formed in a single-stage formation step to make a finished component and in this case is cooled by the cooled forming tool simultaneously at a rate above the critical cooling rate of the steel so that a hardened component is produced. The steel sheet itself is typically cut out from a steel strip wound mostly as a coil and is then further processed. The steel sheet to be formed is frequently referred to as a plate.

Known hot-formable steels for this area of application are e.g. the manganese-boron steel "22MnB5" and latterly also air-hardenable steels according to European patent EP 2 449 138 B1.

In addition to uncoated steel sheets, steel sheets comprising scaling protection for press-hardening are also used (e.g. for car body construction). The advantages here are that, in addition to the increased corrosion resistance of the finished component, the plates or components do not become scaled in the furnace, whereby wearing of the pressing tools by flaked-off scales is reduced and the components often do not have to undergo costly blasting prior to further processing.

Currently, the following (alloy) coatings which are applied by hot-dipping are known for press-hardening: aluminium-silicon (AS), zinc-aluminium (Z), zinc-aluminium-iron (ZF/galvannealed), zinc-magnesium-aluminium (ZM) and electrolytically deposited coatings of zinc-nickel or zinc, wherein the latter is converted to an iron-zinc alloy layer prior to hot-forming. These corrosion protection coatings are conventionally applied to the hot or cold strip in continuous feed-through processes.

The production of components by means of quenching of pre-products of press-hardenable steels by hot-forming in a forming tool is known from German patent DE 601 19 826 T2. In this case, a sheet plate previously heated above the austenitization temperature to 800-1200° C. and possibly provided with a metallic coat of zinc or on the basis of zinc is formed in an occasionally cooled tool by hot-forming to produce a component, wherein during forming, by reason of rapid heat extraction, the sheet or component in the forming tool undergoes quench-hardening (press-hardening) and obtains the required strength properties owing to the resulting martensitic hardness structure.

The production of components by means of quenching of pre-products which are coated with an aluminium alloy and made of press-hardenable steels by hot-forming in a forming tool is known from German patent DE 699 33 751 T2. In this case, a sheet which is coated with an aluminium alloy is heated to above 700° C. prior to forming, wherein an intermetallic alloyed compound on the basis of iron, aluminium and silicon is produced on the surface and subsequently the sheet is formed and cooled at a rate above the critical cooling rate.

Laid-open document US 2011/0300407 A1 discloses a method for producing a press-form-hardened steel sheet for use in the automotive industry. In the hot-dipping process, the steel sheet is provided with an aluminium-silicon (AS) coat with a layer support of 20 to 80 g/m$^2$ and heated to temperatures above 820° C. and the temperature is maintained for a certain amount of time (ca. 3 minutes). Different intermetallic phases are thereby formed in the coat, e.g. $Fe_3Al$, FeAl or Fe—$Al_2O_3$. After hot-forming by means of a press, the product is cooled whilst still in the press.

European patent application EP 2 312 011 A1 also describes a method for producing metallic coatings on cast-moulded parts for the use in the automotive industry. To this end, the cast-moulded part is provided with an aluminium alloy in a melting bath and is then subjected to a heat treatment in an oxidising atmosphere to produce a high-temperature resistant aluminium oxide layer. After the heat treatment, anodic oxidation is also provided.

German patent document DE 198 53 285 C1 proposes a method for producing a protective layer on martensitic steel. In a protective gas atmosphere (argon with 5% $H_2$), the steel to be coated is dipped into a melt of aluminium or an aluminium alloy, is cooled and is then subjected to hot isostatic pressing at the austenitization temperature. The thus produced aluminium protective layer has a thickness of between 100 and 200 μm and is said to have, on its surface, an aluminium oxide layer which is ca. 1 μm thick, but no further details as to how this layer is produced or obtained are provided.

European patent application EP 2 017 074 A2 discloses motor vehicle piping of a steel pipe with an aluminium layer which is applied by means of hot-dip coating. A thickness of an aluminium oxide layer is adjusted during the coating process via the temperature of the aluminium and the oxygen concentration; it is between 4 and 30 nm.

The advantage of the aluminium-based coats compared with the zinc-based coats resides in the fact that, in addition to a larger process window (e.g. in terms of the heating parameters), the finished components do not have to be subjected to blasting prior to further processing. Furthermore, in the case of aluminium-based coats there is no risk of liquid metal embrittlement and micro-cracks cannot form in the near-surface substrate region on the former austenite grain boundaries which, at depths greater than 10 μm, can have a negative effect on the fatigue strength.

However, a disadvantage in the use of aluminium-based coats, e.g. of aluminium-silicon (AS), is the insufficient lacquer-bonding of the formed component in the cathodic dip coating (KTL), typical for automobiles, when a too short heating time has been used for press-hardening. At short heating times, the surface has insufficient roughness and so sufficient lacquer-bonding is not achieved.

In contrast to zinc-based coats, aluminium-based coats cannot phosphatise or cannot phosphatise sufficiently, and therefore no improvement in the lacquer-bonding can be achieved by the phosphatising step. For these reasons, up to now when processing plates with aluminium-based coats minimum heating times must be maintained, whereby the coat is thoroughly alloyed with iron and forms a rough surface topography which effects sufficient lacquer-bonding when lacquering the formed component.

However, thoroughly alloying the coat with iron and forming a surface topography capable of being lacquered requires a correspondingly long dwell time in the typically used roller hearth furnace which considerably prolongs the cycle times and reduces the economic feasibility of the press-form hardening process. The minimum dwell time is thus determined by the coat and not by the main material for which it would be merely necessary to achieve the required austenitization temperature. In addition, the corrosion resistance is reduced by the greater alloying with iron since the aluminium content in the alloy layer decreases during the furnace dwell time and the iron content increases. For AS plates, typically adapted, longer furnaces are used to achieve high cycle rates despite the required furnace dwell time. However, these are more expensive to purchase and to operate and also require a very large amount of space. A further disadvantage of AS coats resides in the fact that with very short annealing times, the welding capability in the spot-welding process is extremely poor. This is expressed e.g. in only a very small welding area. The cause for this is inter alia a very low transition resistance with short annealing times.

The object of the invention is thus to provide a component of a press-form-hardened steel sheet with an aluminium-based coating, which steel sheet is cost-effective to produce and has excellent lacquering capability and welding capability, in particular resistance spot welding capability. Furthermore, a method for producing such a component is to be provided.

SUMMARY OF THE INVENTION

The teaching of the invention includes a component of press-form-hardened steel sheet with an aluminium-based coating, wherein the coating comprises a coat applied in the hot-dipping process and containing aluminium and silicon, which is characterised in that the press-form-hardened component has an inter-diffusion zone I in the transition region between the steel sheet and the coat, wherein, depending upon the layer support of the coat prior to heating and press-hardening, the thickness of the inter-diffusion zone I satisfies the following formula:

$$I\ [\mu m] < 1/35 \times \text{support on both sides}\ [g/m^2] + 19/7$$

a zone having different intermetallic phases having an average overall thickness between 8 and 50 μm is formed on the inter-diffusion zone I, said zone having arranged thereon in turn a cover layer containing aluminium oxide and/or aluminium hydroxide in an average thickness of at least 0.05 μm to at most 5 μm.

Aluminium-based coats are understood hereinafter to be metallic coats, in which aluminium is the main constituent (in mass percent). Examples of possible aluminium-based coats are aluminium-silicon (AS), aluminium-zinc-silicon (AZ), and the same coats with admixtures of additional elements, such as e.g. magnesium, transition metals such as manganese, titanium and rare earths. A coat of the steel sheet in accordance with the invention is produced e.g. in a melting bath with an Si content of 8 to 12 wt. %, an Fe content of 1 to 4 wt. %, with the remaining being aluminium.

The formation of a defined cover layer, containing aluminium oxide and/or aluminium hydroxide, on the aluminium-based coating of the steel sheet or steel strip can considerably reduce or even completely prevent the aforementioned negative aspects of aluminium-based coatings.

The cover layers containing aluminium oxide and/or aluminium hydroxide act on the component formed by press-form-hardening by reason of their mesh-like structure as an ideal adhesion promoter for subsequent lacquering, in particular cathodic dip coating (KTL). Therefore, it is no longer necessary to perform protracted thorough alloying of the aluminium-based coating in the furnace with iron, and so the passage times through the furnace for heating the steel sheet to the forming temperature can be drastically shortened. Whereas previously e.g. for sheet thicknesses of 1.5 mm, annealing times in the roller hearth furnace of at least 4 minutes at 950° C. furnace temperature were required for thorough alloying of the coating with iron and forming a surface topography capable of being lacquered, in the method in accordance with the invention for a sheet thickness of 1.5 mm annealing times of only 2-3 minutes are required and the annealing time is thus significantly reduced. The maximum possible furnace times are not changed by the cover layer containing aluminium oxide and/or aluminium hydroxide. Therefore, the process window for heating at shorter furnace times is greatly expanded.

For thicker sheets, the furnace time is accordingly extended, owing to the lower heating rate of the steel material. The typical furnace temperatures between 900 and 950° C. should also be maintained here. For high cycle times, furnace temperatures between 930 and 950° C. are advantageous.

In addition, the cover layer in accordance with the invention of aluminium oxides and/or aluminium hydroxides has an advantageous effect on the resistance spot welding capability with short furnace times because the transition resistance is increased and effective resistance heating is thus achieved. A thickness of this cover layer of at least 0.05 μm has thus proved to be positive for good welding capability after short heating times.

Experiments have shown that the lacquer-bonding is better, and disbonding owing to a corrosive attack is less, the thicker the cover layer containing aluminium oxide and/or aluminium hydroxide. On the other hand, when this cover layer is too thick, the transition resistance for resistance spot welding is too high, whereby the welding capability would again be impaired. Therefore, a maximum thickness of the cover layer of 5 μm should not be exceeded.

To achieve a good compromise between welding suitability and lacquer-bonding, the cover layer should have a thickness between 0.10 and 3 μm.

Cover layers having an average thickness of between 0.15 and 1 μm are particularly advantageous for excellent welding suitability with effective lacquer-bonding.

In accordance with the invention, the invention likewise includes a method for producing a component, in particular as claimed in claim 1, from a press-form-hardened steel sheet with an aluminium-based coating, with particular suitability for being lacquered and for resistance spot welding, wherein as the coating an aluminium-based coat is applied onto the steel sheet in the hot-dipping process, which is characterised in that

- the steel sheet or steel strip with the coat is subjected, after the hot-dipping process and before the forming process, to a treatment by anodic oxidation and/or plasma oxidation and/or hot water treatment and/or treatment in an atmosphere containing at least variable proportions of oxygen, steam,
- the hot water treatment or the treatment with steam is performed at temperatures of at least 90° C., advantageously at least 95° C.,
- during the treatment on the surface of the coat by forming oxides or hydroxides a cover layer containing aluminium oxide and/or aluminium hydroxide and having a thickness of at least 0.05 μm to at most 5 μm is formed,
- the steel sheet or steel strip is heated at least in sections to a temperature above the austenitization temperature,
- the heated steel sheet or steel strip is then formed and subsequently cooled at a rate which is at least in sections above the critical cooling rate.

In conjunction with the invention, the expression "at least in sections" is to be understood in terms of local portions of the treated steel sheet or steel strip, and so a steel sheet or steel strip with microstructures and properties which deviate from each other locally in a targeted manner can be produced.

The cover layer is preferably applied onto the surface of the coat in a continuous process.

In an advantageous manner, the treatment takes place in an atmosphere which also contains proportions of basic components, preferably ammonia ($NH_3$), of primary, secondary or tertiary aliphatic amines ($NH_2R$, $NHR_2$, $NR_3$).

In terms of process technology, a thin oxide cover layer can advantageously be produced by anodic oxidation (thin-layer anodising), plasma oxidation and a cover layer containing hydroxide can be produced by means of hot water treatment of the aluminium-based coating at temperatures of at least 90° C., advantageously at least 95° C. and/or a treatment in steam at temperatures of at least 90° C., advantageously at least 95° C.

As an alternative to anodising, a gas phase treatment of the AS surface also achieves the same aim. For this purpose, the AS surface is treated with an atmosphere which can contain at least variable proportions of oxygen, steam, optionally also proportions of basic components, in particular ammonia, of primary, secondary or tertiary aliphatic amines. This treatment results in a time- or temperature-controlled growth of a cover layer containing aluminium oxide and/or aluminium hydroxide. Furthermore, the composition of the gas phase can be used to control the layer thickness growth of this cover layer. The treatment is performed at a temperature of 40° C. to 100° C., preferably 90° C. to 100° C. Lower treatment temperatures prolong the treatment duration, treatment temperatures above 100° C. possibly require pressure containers.

Anodising and also gas phase treating result in a cover layer containing aluminium oxide and/or aluminium hydroxide which has mesh-like or needle-like structures on its surface. The thereby associated increase in the surface area improves the adhesion of a subsequent cathodic dip coating.

Since it is no longer necessary to provide longer heating times to form a surface topography capable of being lacquered, the corrosion protection of the coating is also increased. This can be explained in that with only a short annealing time in the roller hearth furnace being necessary, there is less diffusion of aluminium and iron. This also results inter alia in a relatively small inter-diffusion zone. By way of example, this is less than 7 μm for an AS support of the starting material of 150 g/m$^2$ (AS150).

In experiments, depending upon the furnace dwell time when using plates having an AS support of 150 g/m$^2$, thicknesses of the diffusion zone of less than 5 μm, and even less than 4 μm on the finished component can also be achieved.

When using plates having an AS support of 80 g/m$^2$ (AS80), it is known that in this case the furnace time can also be slightly reduced in the case of a coat not in accordance with the invention, and even consequently result in thinner diffusion layers of e.g. 5 μm. Experiments have shown that by using the solution in accordance with the invention, the furnace times can also be even further reduced in this case and as a result thicknesses of the diffusion layers of less than 5 μm on the finished component can be achieved. In further experiments, by further reducing the heating time in the furnace, even further reduced thicknesses of the diffusion layers of less than 3 μm, and even less than 2 μm, on the finished component could be achieved.

When using plates having a layer support between AS80 and AS150 and with layer supports which are less than AS80 or greater than AS150, the thicknesses of the inter-diffusion layers I in accordance with the invention for a layer support of the starting material are produced, after press-hardening, from the linear correlation according to the following formulae for different heating times dependent upon the sheet thickness:

$I$ [μm]<1/35×support on both sides [g/m$^2$]+19/7 (short heating time)

$I$ [μm]<1/35×support on both sides [g/m$^2$]+5/7(very short heating time)

$I$ [μm]<1/35×support on both sides [g/m$^2$]+2/7(extremely short heating time)

In accordance with the invention, the required heating time in the furnace is based only on the sheet thickness because the coat in accordance with the invention does not require any dwell time in the furnace to produce a surface capable of being lacquered. Thicker sheets thus require longer heating times than thinner sheets for heating.

By way of example, for sheets with a thickness of 1.5 mm, table 1 lists short heating times (220 seconds), very short heating times (180 seconds) and extremely short heating times (150 seconds) compared with typical heating times (360 seconds) in the roller hearth furnace.

A further positive effect of the short heating time is a considerably reduced porosity in the alloy layer and in the diffusion zone. Pores are produced during longer annealing times e.g. by the Kirkendall effect. Experiments have shown that, owing to the short annealing time, the overall porosity can be reduced to values of less than 6%, and even to values of less than 4% or 2%. This can have e.g. an advantageous effect on the welding suitability.

For press-form-hardening of plates with an aluminium-silicon coating, it is now no longer necessary to adhere to long dwell times of the steel sheet in the furnace. The steel sheet still only has to be heated to the required forming temperature and, as soon as the forming temperature is reached, can be immediately supplied to the forming press, formed and quenched.

As a result, advantageously shorter roller hearth furnaces than were previously employed can also be used. Furthermore, the use of other types of furnace e.g. for inductive or conductive rapid heating is possible, without the heated plates having to be kept at a temperature for forming a surface topography capable of being lacquered.

Furthermore, it is now possible to only partially heat and harden plates, whereby good spot welding capability and cathodic dip coating are achieved even in regions with a low heat effect.

BRIEF DESCRIPTION OF THE DRAWING

The invention will be described in more detail hereinafter with the aid of the illustrated figures. It is shown in.

DETAILED DESCRIPTION OF PREFERRED EMBODIMENTS

Figure 1:
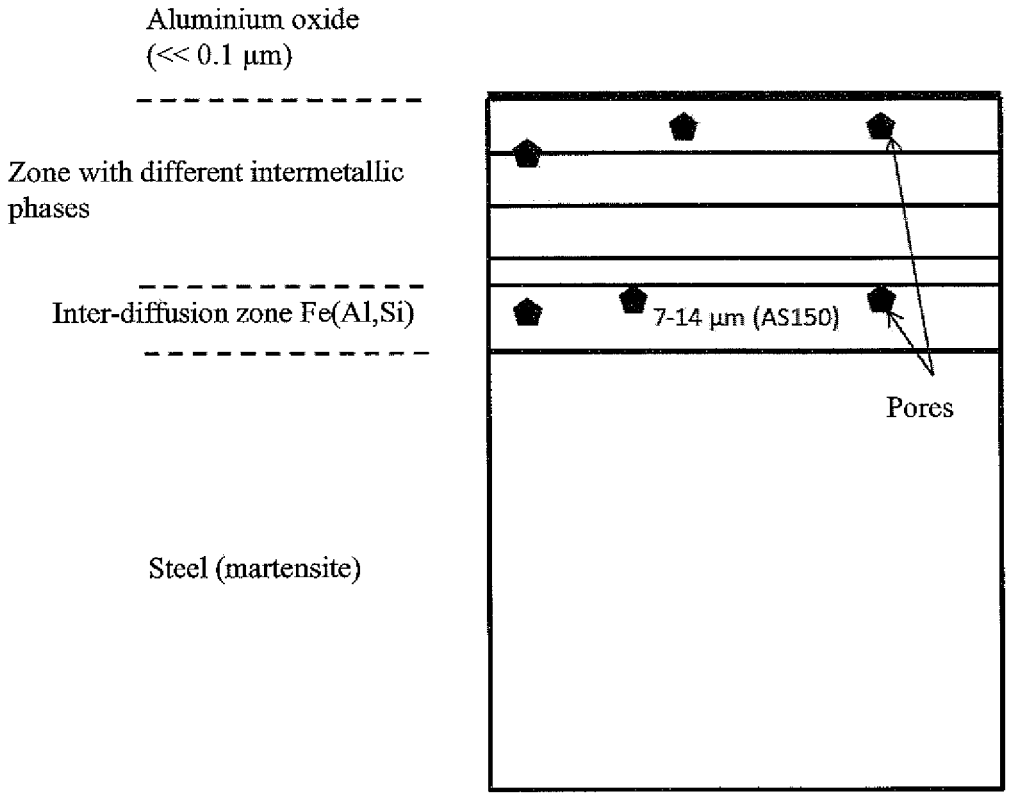
FIG. 1 illustrates a layer structure of a coating on a press-form-hardened component having a coating of AS and typical long heating time.

FIG. 1 schematically illustrates the layer structure of the coating on a press-form-hardened component having a coating of AS and typical long heating time to achieve a thorough alloying of the coat with iron, in accordance with the prior art. For the component, a steel sheet having a coat of AS150, i.e., with a layer support of the coat of 150 g/m$^2$, was used. Formed on the martensitic steel base material is an inter-diffusion zone Fe(Al,Si) having a thickness of 7 to 14 μm, on which a zone having different intermetallic phases (e.g. $Fe_2SiAl_2$ and $FeAl_2$) has been formed, wherein the individual phases in this zone can occur distributed in the form of lines or also clusters. By way of the oxidation in the furnace and during transfer into the press, only a very thin aluminium oxide layer having a thickness of less than 0.05 μm was formed. Pores which have formed in the different zones can also be seen.

Figure 2:
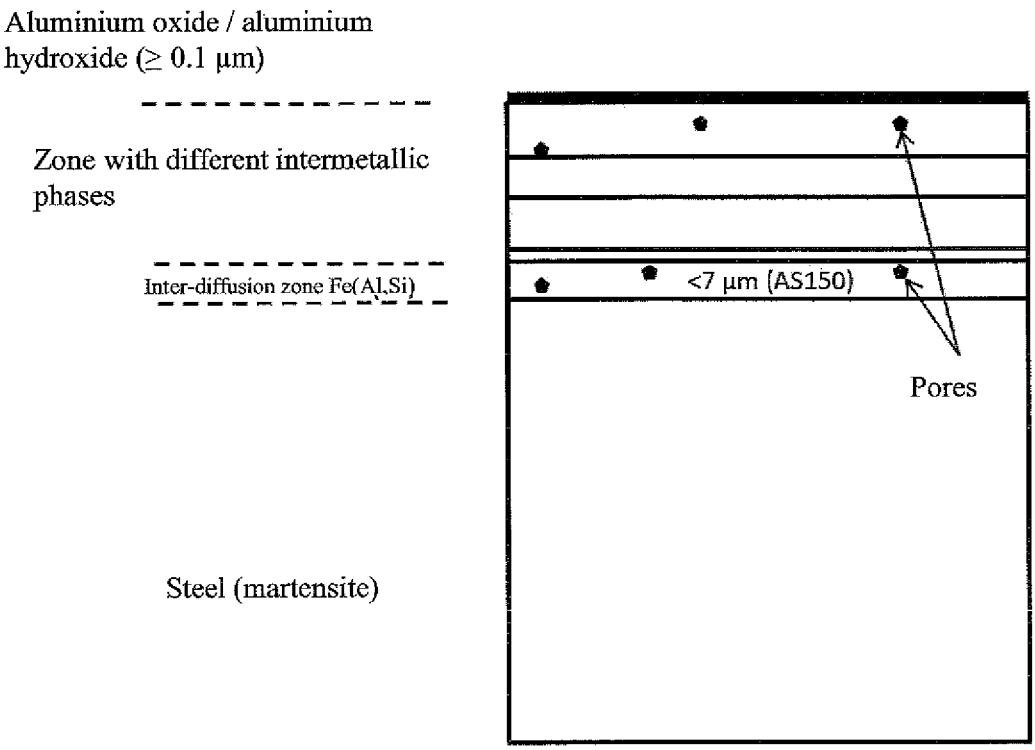
FIG. 2 illustrates a layer structure of a coating in accordance with the invention.

In comparison thereto, FIG. 2 illustrates the layer structure of a coating in accordance with the invention on a press-form-hardened component having an AS coating on which a cover layer in accordance with the invention containing aluminium oxide and/or aluminium hydroxide of at least 0.05 μm is formed and which was produced with reduced heating times compared with the prior art. In the transition region between the steel sheet and the coating an inter-diffusion zone is formed in which aluminium and silicon have diffused into the steel Fe(Al,Si). Owing to the only very short heating time required in the furnace to austenitization temperature, this layer has e.g. for AS150 a thickness of less than 7 μm on average. Formed on this layer during heating is a further layer having different intermetallic phases (e.g. $Fe_2SiAl_2$ and $FeAl_2$), wherein the individual phases in this zone can occur distributed in the form of lines or also clusters, on which a cover layer containing aluminium oxide and/or aluminium hydroxide having an average thickness of at least 0.05 μm to at most 5 μm is arranged.

Figure 3:
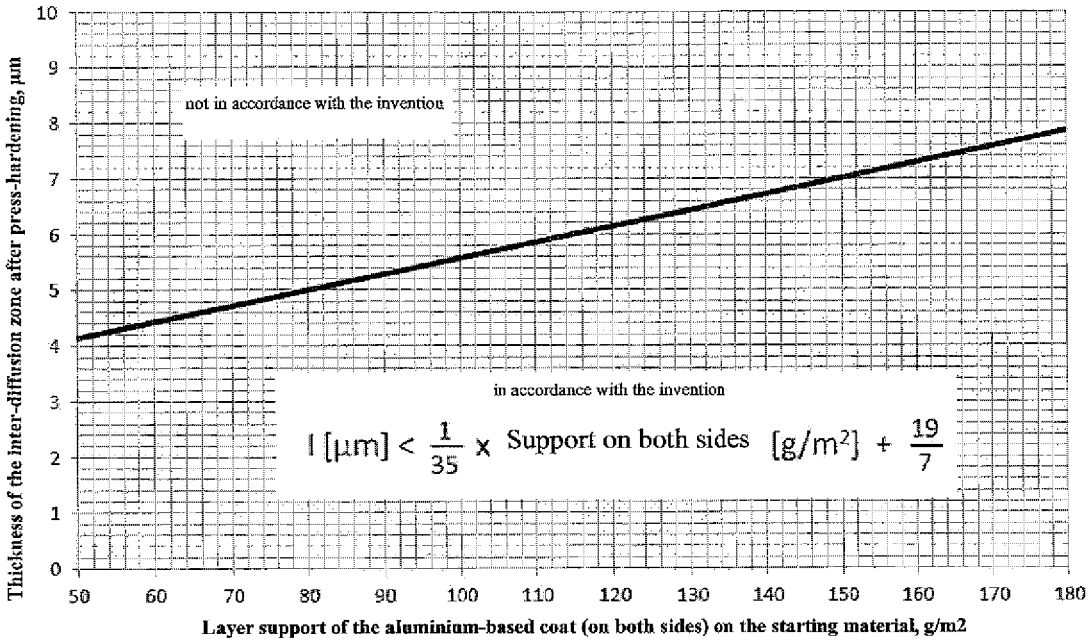
FIG. 3 shows a graph of the thickness I in accordance with the invention of an inter-diffusion zone for a layer support of a starting material.

FIG. 3 shows a graph of the thickness I in accordance with the invention of the inter-diffusion zone for a layer support of the starting material between 50 g/m$^2$ and 180 g/m$^2$ in accordance with the following relationship:

$$I\ [\mu m] < 1/35 \times \text{support on both sides}\ [g/m^2] + 19/7$$

Table 1 summarises experiments for lacquer-bonding (phosphatising treatment, typical for automobiles, and cathodic dip coating; testing after 72 hours, constant condensation-water atmosphere as per DIN EN ISO 6270-2: 2005 CH) and welding suitability (resistance spot welding) of press-hardened AS150 samples at 940° C. furnace temperature and different heating times. The sheet thickness of the samples is 1.5 mm. It can be seen that a good lacquer-bonding and welding suitability are only produced at heating times of 220 s and lower if a cover layer in accordance with the invention containing aluminium oxide and/or aluminium hydroxide is provided. At short heating times of 220 s and lower, inter-diffusion layers of less than 7 μm are also produced on the press-hardened component. In contrast, at the long heating times of 360 s which are part of the prior art and not in accordance with the invention, a good lacquer-bonding and welding suitability are also produced in the samples without the cover layer in accordance with the invention containing aluminium oxide and/or aluminium hydroxide, owing to the thorough alloying of the coat with iron. The thickness of the inter-diffusion layers is clearly above 7 μm after a heating time of 360 s.

TABLE 1

| No. | Material | Thickness | Support | Cover layer | Furnace temperature | Furnace dwell time | Welding area | Cathodic dip coating | Thickness of the diffusion layer | In accordance with the invention |
|---|---|---|---|---|---|---|---|---|---|---|
| 1 | 22MnB5 | 1.5 mm | AS150 | No | 940° C. | 150 s | not okay | not okay | <7 μm | No |
| 2 | 22MnB5 | 1.5 mm | AS150 | Deposition time a | 940° C. | 150 s | >1 kA (okay) | okay | <7 μm | Yes |
| 3 | 22MnB5 | 1.5 mm | AS150 | Deposition time b | 940° C. | 150 s | >1 kA (okay) | okay | <7 μm | Yes |
| 4 | 22MnB5 | 1.5 mm | AS150 | Deposition time c | 940° C. | 150 s | >1 kA (okay) | okay | <7 μm | Yes |
| 5 | 22MnB5 | 1.5 mm | AS150 | No | 940° C. | 180 s | not okay | not okay | <7 μm | No |
| 6 | 22MnB5 | 1.5 mm | AS150 | Deposition time a | 940° C. | 180 s | >1 kA (okay) | okay | <7 μm | Yes |
| 7 | 22MnB5 | 1.5 mm | AS150 | Deposition time b | 940° C. | 180 s | >1 kA (okay) | okay | <7 μm | Yes |
| 8 | 22MnB5 | 1.5 mm | AS150 | Deposition time c | 940° C. | 180 s | >1 kA (okay) | okay | <7 μm | Yes |

TABLE 1-continued

| No. | Material | Thick-ness | Support | Cover layer | Furnace temperature | Furnace dwell time | Welding area | Cathodic dip coating | Thickness of the diffusion layer | In accordance with the invention |
|---|---|---|---|---|---|---|---|---|---|---|
| 9 | 22MnB5 | 1.5 mm | AS150 | No | 940° C. | 220 s | not okay | not okay | <7 μm | No |
| 10 | 22MnB5 | 1.5 mm | AS150 | Deposition time a | 940° C. | 220 s | >1 kA (okay) | okay | <7 μm | Yes |
| 11 | 22Mn85 | 1.5 mm | AS150 | Deposition time b | 940° C. | 220 s | >1 kA (okay) | okay | <7 μm | Yes |
| 12 | 22MnB5 | 1.5 mm | AS150 | Deposition time c | 940° C. | 220 s | >1 kA (okay) | okay | <7 μm | Yes |
| 13 | 22MnB5 | 1.5 mm | AS150 | No | 940° C. | 360 s | >1 kA (okay) | okay | >7 μm | No |
| 14 | 22MnB5 | 1.5 mm | AS150 | Deposition time a | 940° C. | 360 s | >1 kA (okay) | okay | >7 μm | No |
| 15 | 22MnB5 | 1.5 mm | AS150 | Deposition time b | 940° C. | 360 s | >1 kA (okay) | okay | >7 μm | No |
| 16 | 22MnB5 | 1.5 mm | AS150 | Deposition time c | 940° C. | 360 s | >1 kA (okay) | okay | >7 μm | No |

What is claimed is:

1. A component of press-form-hardened steel sheet, said component comprising:

an aluminium-based coating upon the press-form-hardened steel sheet;

the coating comprising a coat containing aluminium and silicon, said coat being applied upon the steel sheet in a hot-dipping process;

an inter-diffusion zone formed in a transition region between the steel sheet and the coat at a thickness which is defined in dependence on a layer support of the coat prior to heating and presshardening and satisfies the following formula:

$$I\ [\mu m] < 1/35 \times \text{layer support on both sides } [g/m^2] + 19/7,$$

wherein I is the inter-diffusion zone;

wherein the layer support is between 50 g/m and 180 $g/m^2$;

a zone formed on the inter-diffusion zone and having different intermetallic phases with an average overall thickness between 8 and 50 μm; and a cover layer arranged on the zone and containing aluminium oxide and/or aluminium hydroxide at an average thickness of at least 0.05 μm to at most 5 μm.

2. The component of claim 1, wherein, depending upon a layer support of a starting material, the thickness of the inter-diffusion zone is formed in accordance with the following formula $$I\ [\mu m] < 1/35 \times \text{layer support on both sides } [g/m^2] + 5/7.$$

3. The component of claim 1, wherein, depending upon a layer support of a starting material, the thickness of the inter-diffusion zone is formed in accordance with the following formula $$I\ [\mu m] < 1/35 \times \text{layer support on both sides } [g/m^2] - 2/7,$$

4. The component of claim 1, wherein the cover layer has an average layer thickness of at least 0.10 μm and at most 3.0 μm.

5. The component of claim 1, wherein the cover layer has an average layer thickness of at least 0.15 μm and at most 1.0 μm.

6. The component of claim 1, wherein the coat has an overall porosity of less than 6%.

7. The component of claim 1, wherein the coat has an overall porosity of less than 4%.

8. The component of claim 1, wherein the coat has an overall porosity of less than 2%.

9. The component of claim 1, wherein the coat is produced in a melting bath with an Si content of 8 to 12 wt. %, an Fe content of 1 to 4 wt. %, with the remainder being aluminium and unavoidable impurities.

* * * * *